US007690364B2

(12) United States Patent
Grunwald et al.

(10) Patent No.: US 7,690,364 B2
(45) Date of Patent: Apr. 6, 2010

(54) METHOD FOR DETERMINING THE INJECTION CORRECTION WHEN CHECKING THE TIGHTNESS OF A TANK VENTILATION SYSTEM

(75) Inventors: Oliver Grunwald, Ingolstadt (DE); Matthias Wiese, Frankfurt am Main (DE); Hong Zhang, Tegernheim (DE)

(73) Assignee: Continental Automotive GmbH, Hannover (DE)

( * ) Notice: Subject to any disclaimer, the term of this patent is extended or adjusted under 35 U.S.C. 154(b) by 92 days.

(21) Appl. No.: 11/913,918

(22) PCT Filed: May 4, 2006

(86) PCT No.: PCT/EP2006/062034

§ 371 (c)(1),
(2), (4) Date: Nov. 29, 2007

(87) PCT Pub. No.: WO2006/120153

PCT Pub. Date: Nov. 16, 2006

(65) Prior Publication Data

US 2008/0195296 A1 Aug. 14, 2008

(30) Foreign Application Priority Data

May 12, 2005 (DE) ..... 10 2005 022 121

(51) Int. Cl.
*F02M 33/02* (2006.01)

(52) U.S. Cl. ..... 123/520; 123/519; 123/516; 123/698; 701/103

(58) Field of Classification Search ..... 123/518–521, 123/698, 516; 701/103, 108
See application file for complete search history.

(56) References Cited

U.S. PATENT DOCUMENTS

| | | | | |
|---|---|---|---|---|
| 5,125,385 | A * | 6/1992 | Frinzel | 123/698 |
| 5,315,980 | A | 5/1994 | Otsuka et al. | 123/520 |
| 5,572,981 | A | 11/1996 | Pfleger et al. | 123/698 |
| 5,680,849 | A | 10/1997 | Morikawa et al. | 123/520 |
| 5,878,732 | A | 3/1999 | Engl et al. | 123/673 |
| 6,234,153 | B1 | 5/2001 | DeGroot et al. | 123/525 |
| 6,374,812 | B1 * | 4/2002 | Wiese | 123/520 |
| 6,523,531 | B1 | 2/2003 | Feldkamp et al. | 123/698 |

(Continued)

FOREIGN PATENT DOCUMENTS

DE 4427688 2/1996

(Continued)

*Primary Examiner*—Stephen K Cronin
*Assistant Examiner*—Anthony L Bacon
(74) *Attorney, Agent, or Firm*—King & Spalding L.L.P.

(57) ABSTRACT

A tank ventilating valve is disposed in a regeneration pipe which connects a storage container collecting fuel gas of a fuel tank to an intake pipe of the internal combustion engine. The tank ventilation system is air tightly sealed towards the atmosphere prevailing outside the motor vehicle while the tank ventilating valve is opened to create a negative pressure in the tank ventilation system. The method has the following steps: determining the fuel gas charge of the storage container; determining the volume flow rate through the tank ventilating valve; calculating an intermediate value from the product of the load and the volume flow rate; determining a tank pressure difference between the pressure prevailing in the fuel tank and the atmospheric pressure; and determining the additive corrective value by adjusting the intermediate value to the amount of the tank pressure difference.

18 Claims, 3 Drawing Sheets

U.S. PATENT DOCUMENTS

| | | | | |
|---|---|---|---|---|
| 6,708,682 | B2 * | 3/2004 | Osanai | 123/698 |
| 2002/0170550 | A1 * | 11/2002 | Mitsutani | 123/674 |
| 2003/0047161 | A1 | 3/2003 | Bagnasco et al. | 123/295 |
| 2005/0240336 | A1 | 10/2005 | Reddy | 701/103 |

FOREIGN PATENT DOCUMENTS

| | | |
|---|---|---|
| DE | 19612453 | 10/1997 |
| DE | 10143329 | 9/2001 |
| EP | 1253311 | 4/2002 |

* cited by examiner

METHOD FOR DETERMINING THE INJECTION CORRECTION WHEN CHECKING THE TIGHTNESS OF A TANK VENTILATION SYSTEM

CROSS-REFERENCE TO RELATED APPLICATIONS

This application is a U.S. national stage application of International Application No. PCT/EP2006/062034 filed May 4, 2006, which designates the United States of America, and claims priority to German application number 10 2005 022 121.1 filed May 12, 2005, the contents of which are hereby incorporated by reference in their entirety.

TECHNICAL FIELD

The invention relates to a method for determining an additive correction value for correcting the quantity of fuel injected in an internal combustion engine, the method being implemented while checking the tightness of a tank ventilation system. In the tank ventilation system a tank ventilation valve is disposed in a regeneration line, which connects a retention vessel collecting fuel gas from a fuel tank to an intake pipe of the internal combustion engine and the tank ventilation system is sealed off in an airtight manner from the atmosphere prevailing outside the motor vehicle and the tank ventilation valve is opened to build up a negative pressure in the tank ventilation system.

BACKGROUND

A method is known from DE 44 27 688 A1 for checking the functional capacity of a tank ventilation system, wherein the tank ventilation system is sealed off in an airtight manner from the atmosphere by way of a check valve and then a tank ventilation valve is opened to establish a connection to the intake pipe of an internal combustion engine, with the result that a negative pressure builds up in the tank ventilation system. The dynamic pattern of the pressure drop in the tank ventilation system is used to evaluate the functional capacity of the tank ventilation system and to determine any lack of tightness or leaks present. The same evaluation takes place after the tank ventilation valve has been closed based on the analysis of the pressure build up taking place.

An activated carbon filter in the tank ventilation system collects the fuel gas leaving a fuel tank, thereby operating as a retention vessel. Opening the tank ventilation valve establishes a connection by way of a regeneration line between the retention vessel and the intake pipe, by way of which the hydrocarbons present in the retention vessel are supplied to the intake air of the internal combustion engine. The resulting sudden enrichment with hydrocarbons of the fuel/air mixture to be combusted results in a similarly sudden change in the air ratio lambda of the exhaust gas of the internal combustion engine. A generally present lambda regulating facility responds too slowly to such a sudden enrichment, which it is why it is proposed for example in DE 196 12 453 A1 that the enrichment of the fuel/air mixture occurring when the tank ventilation valve is opened should be taken into account when calculating the quantity of fuel to be introduced by way of the injection system into the internal combustion engine, in other words that the calculated injection time should be corrected by way of an additive value.

In order to be able to determine the additive correction value, it is necessary to determine the quantity of fuel supplied additionally by way of tank ventilation. Until now this has generally been done by way of the level of loading of the retention vessel with hydrocarbons. For the period of opening of the tank ventilation valve it is hereby assumed that the retention vessel discharges in a regular manner, in other words that a volume flow with a constant fuel concentration is supplied to the intake pipe. A constant additive correction value is determined accordingly from a loading value determined before discharge and is only changed after the retention vessel has been completely discharged and the loading has been determined once again. Particular structural embodiments of the retention vessel can however result in clear fluctuations in fuel concentration, which are not taken adequately into account by way of the constant additive correction value.

SUMMARY

According to an embodiment, the fluctuations in fuel concentration are taken into account by a method for determining an additive correction value for correcting the quantity of fuel injected in an internal combustion engine, wherein the method is carried out while checking a leak tightness of a tank ventilation system, wherein in the tank ventilation system a tank ventilation valve is disposed in a regeneration line, which connects a retention vessel collecting fuel gas from a fuel tank to an intake pipe of the internal combustion engine, the method comprising the steps of: —sealing off the tank ventilation system in an airtight manner from the atmosphere prevailing outside the motor vehicle, —opening the tank ventilation valveto build up a negative pressure in the tank ventilation system, —determining the loading of the retention vessel with fuel gas, —determining the volume flow through the tank ventilation valve, —calculating an intermediate value from the product of loading and volume flow, —determining a tank pressure difference between the pressure in the fuel tank and the atmospheric pressure, and —determining the additive correction value by adjusting the intermediate value to the size of the tank pressure difference.

According to a further embodiment, the intermediate value can be enlarged as the tank pressure difference increases. According to a further embodiment, the product of loading and volume flow can be scaled with a freely calibratable factor. According to a further embodiment, the difference between the air ratio of the exhaust gas of the internal combustion engine measured by a lambda probe and the air ratio to be set by a lambda regulator can be determined and the additive correction value is changed as a function of the difference. According to a further embodiment, the additive correction value can be reduced, if the difference between the air ratio to be set and the air ratio measured indicates an operation of the internal combustion engine that is too lean. According to a further embodiment, the additive correction value can be enlarged, if the difference between the air ratio to be set and the air ratio measured indicates an operation of the internal combustion engine that is too rich. According to a further embodiment, the difference can be compared with a predetermined limit value and if it exceeds the limit value, the degree of adjustment of the intermediate value to the tank pressure difference is changed. According to a further embodiment, the adjustment of the intermediate value to the tank pressure difference can be effected by way of a characteristic curve, the rise of which is constantly positive above the tank pressure difference and that the characteristic curve is lowered during operation that is too lean and raised during operation that is too rich. According to a further embodiment, the loading of the retention vessel can be determined from the difference between the air ratio of the exhaust gas of the internal combustion engine measured by a lambda probe and the air ratio to be set by a lambda regulator, with the difference being determined during an opening phase of the tank ventilation valve.

BRIEF DESCRIPTION OF THE DRAWINGS

The invention is described in more detail below with reference to an exemplary embodiment and the drawing, in which.

DETAILED DESCRIPTION

Figure 1:
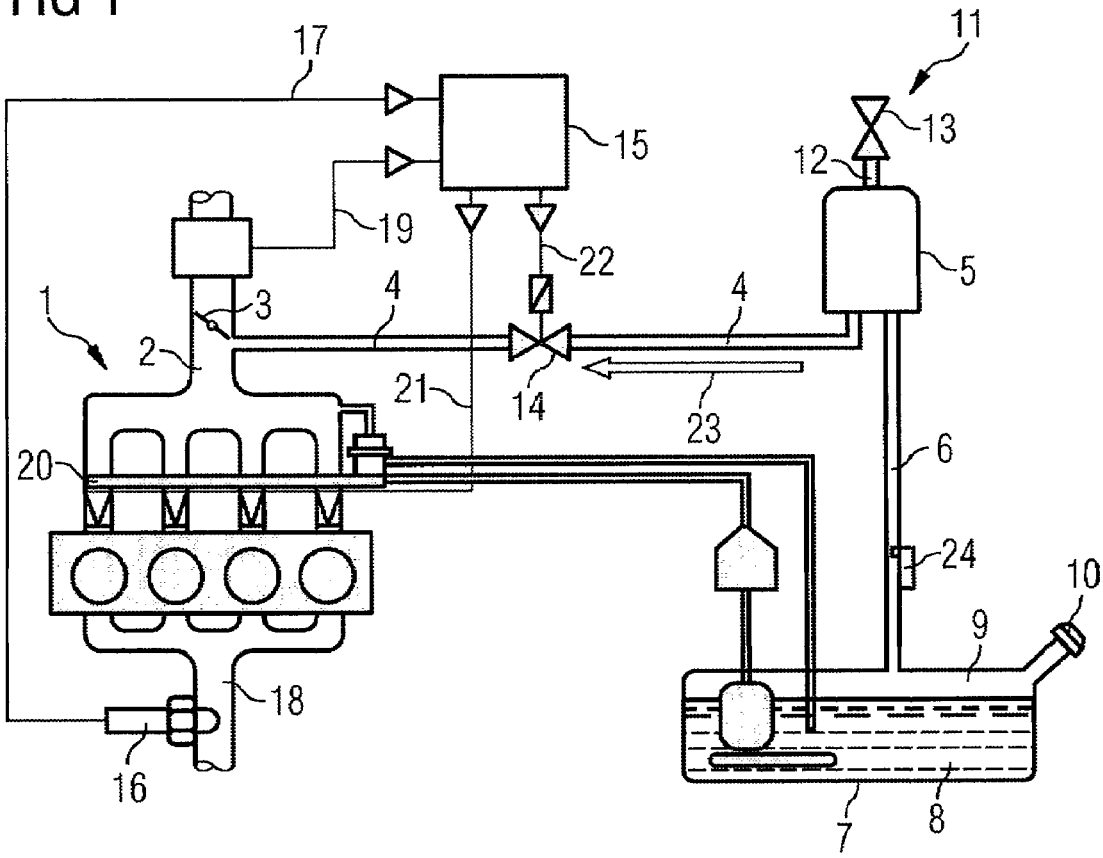
FIG. 1 shows an internal combustion engine with fuel tank and tank ventilation system.

Fluctuations in the fuel concentration of the gas flowing through the regeneration line are due to the different levels of absorption of fuel gases from the fuel tank as the negative pressure builds up. The opening of the tank ventilation valve therefore connects not only the retention vessel but also the fuel tank connected to the retention vessel to the intake pipe. While the negative pressure builds up, in contrast to the normal flushing of the retention vessel, the connection to the atmosphere outside is broken, in other words the negative pressure of the intake pipe does not cause fresh air to be taken in from outside, instead causing the fuel gas present in the fuel tank to be taken in. It has now been identified that the quantity of gas taken in from the fuel tank is a function in particular of the current loading of the retention vessel and the current volume flow through the tank ventilation valve and the tank pressure difference between the tank and the outside atmosphere. These three variables are therefore used to determine the additive correction value. The correction value calculated in this manner for adjusting the injection quantity to the quantity of fuel supplied by way of the tank ventilation system while the negative pressure builds up therefore follows the actual value of the fuel concentration more precisely. A problem with the fuel/air mixture in the internal combustion engine, in other words too lean or too rich operation, can therefore largely be avoided.

In one embodiment, the intermediate value is enlarged as the tank pressure difference increases. This happens if the additive correction value is then deducted from the injection quantity or injection time. This takes into account the fact that when the tank pressure difference is greater, the tendency toward degasification in the fuel tank increases, in other words more fuel gas is available in the tank to be taken off by way of the regeneration line. An increase in fuel in the regeneration gas must then be compensated for by a significant reduction in the quantity of fuel added by way of the injection system. The increase in the intermediate value can be calculated by way of an additive element that is a function of the tank pressure difference or a factor that is a function of the tank pressure difference. An additive element or factor can also be read from a characteristic curve.

In a further embodiment the product of loading and volume flow is scaled using a freely calibratable factor. This makes it possible to adjust the tendency of the fuel in the tank to degasify, which is a function of the loading, in relation to the calculated variable for the injection quantity.

According to a further embodiment, the difference between the air ratio (lambda) of the exhaust gas of the internal combustion engine measured by a lambda regulator and the air ratio to be set by a lambda regulator is determined and the additive correction value is changed according to the air ratio difference. The adjustment of the correction value to a lambda change thus effected ensures that changes in the fuel/air mixture due to unmodeled influencing variables, for example temperature and fuel type, are also detected and taken into account.

In embodiments of the development the additive correction value is reduced, if the difference between the air ratio to be set and the air ratio measured indicates that the operation of the internal combustion engine is too lean and the additive correction value is enlarged, if the difference between the air ratio to be set and the air ratio measured indicates that the operation is too rich. These embodiments can then be applied again, if the additive correction value is deducted from the injection quantity or the injection time.

In a sub-embodiment the air ratio is compared with a predetermined limit value and if it exceeds the limit value the degree of adjustment of the intermediate value to the tank pressure difference is changed. Since it can generally be assumed that the unmodeled influencing variables resulting in a lambda change, such as temperature and fuel type, change only very slowly or not at all during a journey, the calculation of the additive correction value is adapted correspondingly. Waiting for a limit value to be exceeded means that the gas run time within the tank ventilation system is taken into account, in other words the period between the opening of the tank ventilation valve, i.e. the corresponding start of correction of the injection quantity, and the effect of the additionally supplied fuel gas on the air ratio of the exhaust gas. Since the gas run time is greater than the time constant of the lambda regulation, an immediate change to the adjustment to the tank pressure difference can result in fluctuations between injection correction and lambda regulation. This is avoided by introducing the limit value.

If the injection quantity is reduced by the additive correction value, in other words if the intermediate value is enlarged as the tank pressure difference increases, the degree of enlargement is reduced for operation that is too lean and increased for operation that is too rich. If a characteristic curve is used, this characteristic curve has a pattern with a constantly positive rise above the tank pressure difference and the characteristic curve is lowered in lean operation and raised in operation with a rich mixture.

According to a further embodiment the loading of the retention vessel is determined from the difference between the air ratio of the exhaust gas of the internal combustion engine measured by a lambda probe and the air ratio to be set by a lambda regulator, with the difference being determined during an opening phase of the tank ventilation valve.

The internal combustion engine 1 of a motor vehicle shown in FIG. 1 has an intake pipe 2, in which a throttle valve 3 is located. The intake pipe 2 is connected by way of a regeneration line 4 to a retention vessel 5 of a tank ventilation system and the retention vessel 5 in turn is connected by way of a ventilation line 6 to a fuel tank 7. The fuel gas 9 collecting above the liquid fuel 8 in the fuel tank 7 enters the retention vessel 5 by way of the ventilation line 6 and is collected there in an activated carbon filter. The fuel tank 7 is sealed by way of a tank lid 10. The retention vessel 5 is connected to the outside atmosphere 11 by way of an aeration line 12. This connection can be interrupted by way of a check valve 13. A tank ventilation valve 14 is disposed in the regeneration line 4. A engine controller 15, in which a computing unit for example is located, is fed a number of sensor variables of the internal combustion engine 1, including the air ratio 17 of the exhaust gas leaving the internal combustion engine 1 by way of an exhaust gas system 18 determined by way of a lambda probe 16 and the gas mass flow 19 of the air taken into the internal combustion engine 1 by way of the intake pipe 2. The computing unit of the engine controller 15 uses these and further variables, such as the rotation speed and torque of the internal combustion engine 1 for example, to determine various control variables for influencing the operation of the internal combustion engine 1, among them the injection time 21 to be set at an injection system 20 for the supply of fuel. The computing unit of the engine controller 15 also determines the degree of opening 22 of the tank ventilation valve 14.

To check the tightness of the tank ventilation system the check valve 13 is closed, so there is no longer a connection to the outside atmosphere 11. The tank ventilation valve 14 is then opened, with the result that the negative pressure prevailing in the intake pipe 2 extends in the tank ventilation system by way of the regeneration line 4 and the ventilation line 6. As the negative pressure builds up, the fuel/air mixture present in the tank ventilation system flows through the tank ventilation valve 14 and generates a volume flow 23. The tank pressure difference $\Delta p$ between the pressure in the fuel tank 7 and the pressure of the outside atmosphere 11 is determined by way of the differential pressure sensor 24 in the ventilation line 6 and fed to the engine controller 15.

Figure 2:
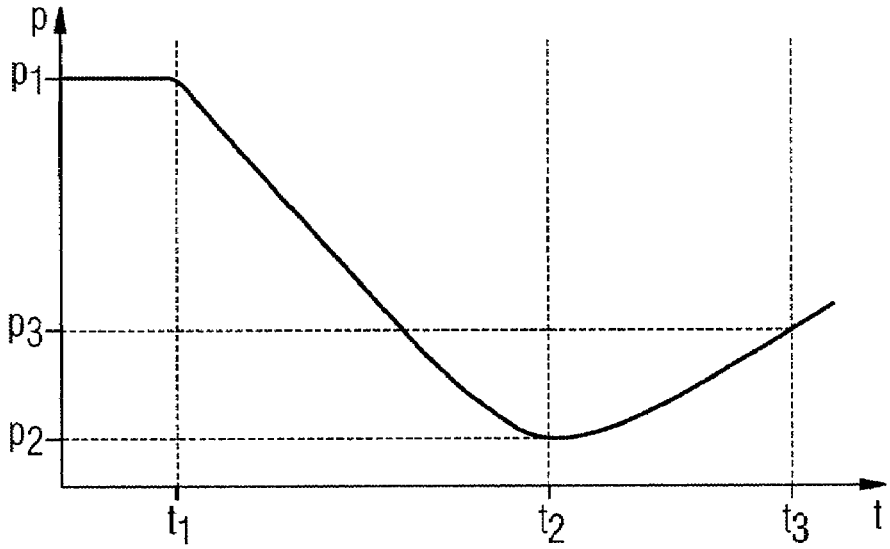
FIG. 2 shows the pattern of the pressure in the tank ventilation system while checking the tightness.

FIG. 2 shows the pattern of the pressure p in the tank ventilation system over time t while checking the tightness. The tightness check takes place in essentially two steps: the check on the build up of negative pressure between times $t_1$ and $t_2$ and the check on the drop in negative pressure between times $t_2$ and $t_3$. At time $t_1$, after the check valve 13 has been closed, the tank ventilation valve 14 is opened and the negative pressure extends in the tank ventilation system, in other words the pressure p drops from an initial value $p_1$ to a minimum $p_2$. At time $t_2$ the tank ventilation valve 14 is closed again and the check on the negative pressure drop starts, until a pressure $p_3$ is attained at time $t_3$. The gradient of the build up in negative pressure and the drop in negative pressure is analyzed according to DE 44 27 688 A1, in order to identify any lack of tightness or leaks present.

Figure 3:
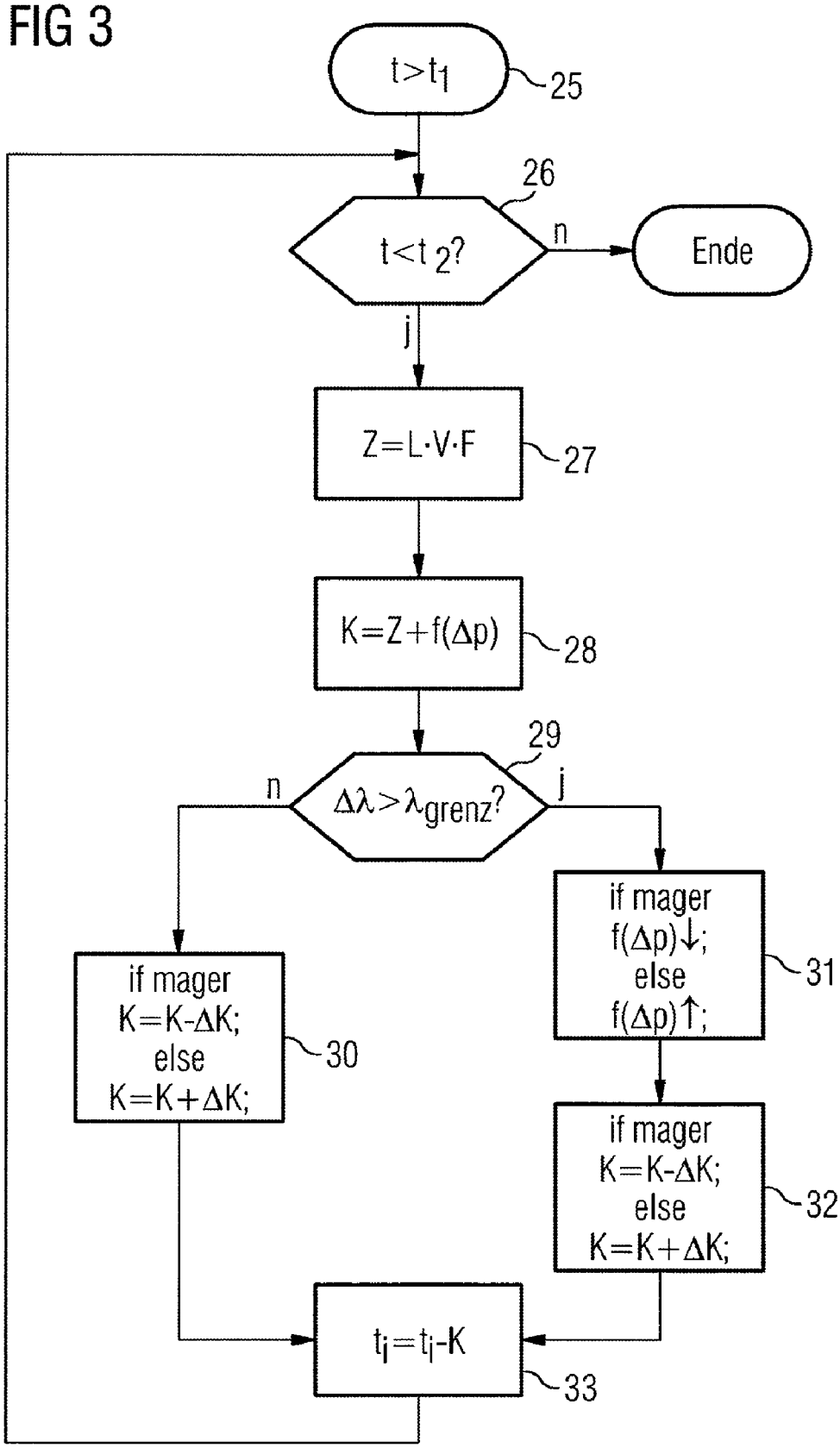
FIG. 3 shows a flow chart for determining the additive correction value.

During the negative pressure build up, in other words between times $t_1$ and $t_2$, the method according to FIG. 3 is executed in the computing unit of the engine controller 15, serving to determine an additive correction value K, which is used to calculate the injection time 21. The actual injection time 21 to be set is calculated by subtracting the correction value K from the injection time $t_i$ calculated according to known methods, in other words the quantity of fuel to be supplied by way of the injection system 20 is reduced, since additional fuel gas is introduced into the intake pipe 2 by way of the regeneration line 4.

The loading L of the retention vessel 5 is determined during normal flushing of the tank ventilation system before the start of the tightness check. This is done by analyzing the air ratio difference $\Delta\lambda$ occurring during the opening of the tank ventilation valve 14, with the air ratio difference $\Delta\lambda$ referring to the difference between the air ratio 17 of the exhaust gas of the internal combustion engine 1 measured by the lambda probe 16 and the air ratio to be set by means of the engine controller.

After the start of the negative pressure build up (step 25), in other words after the check valve 15 has been closed and the tank ventilation valve 14 opened and therefore the time $t_1$ has been exceeded, it is checked in step 26 whether the negative pressure built up check is still running, in other words whether the time $t_2$ has yet been reached. If so, in step 27 an intermediate value Z scalable by a factor F is calculated from the loading L and the volume flow V currently flowing through the tank ventilation valve. The intermediate value Z essentially takes into account the quantity of fuel gas currently flowing out of the retention vessel 5. The volume flow V here corresponds to the volume flow 23 from FIG. 1 and it can either be measured or calculated by way of a physical model. In step S28 the measured tank pressure difference $\Delta p$ is integrated into a function f, in which the relationship between tank pressure difference $\Delta p$ and the quantity of fuel gas 9 present in the fuel tank 7 is given. The fuel gas element determined by way of $f(\Delta p)$, which essentially indicates the quantity of fuel gas subsequently flowing by way of the ventilation line 6 in the direction of the tank ventilation valve 14, is added to the intermediate value Z. with the correction value K resulting.

Then in step 29 a distinction is made. It is checked whether the air ratio difference $\Delta\lambda$ determined during the current opening of the tank ventilation valve 14 exceeds a limit value $\lambda_{limit}$. If not, step 30 is executed. If the air ratio difference $\Delta\lambda$ points in the direction of lean engine operation the correction value K is reduced by an element $\Delta K$. In the case of rich engine operation the correction value K is increased by an element $\Delta K$. The size of $\Delta K$ is determined by way of a characteristic curve that is a function of $\Delta\lambda$. The correction value K is then forwarded to the function for calculating injection time $t_i$ (step 33). If the air ratio difference $\Delta\lambda$ exceeds the limit value $\lambda_{limit}$, not only is the correction value K changed according to the type of engine operation (step 32) but in step 31 the function $f(\Delta p)$ is also corrected, as clearly a permanent air ratio difference that cannot be corrected by lambda regulation of the engine controller 15 is present. If the engine operation is too lean, the influence of the tank pressure difference $\Delta p$ on the correction value K is reduced by lowering the function $f(\Delta p)$ and if the engine operation is too rich it is increased by raising it. The correction value K is then also forwarded to the calculation of the injection time $t_i$ (step 33) and the method continues with step 26. If the time $t_2$ is reached and the negative pressure build up is therefore terminated, the injection correction method is also terminated.

Figure 4:
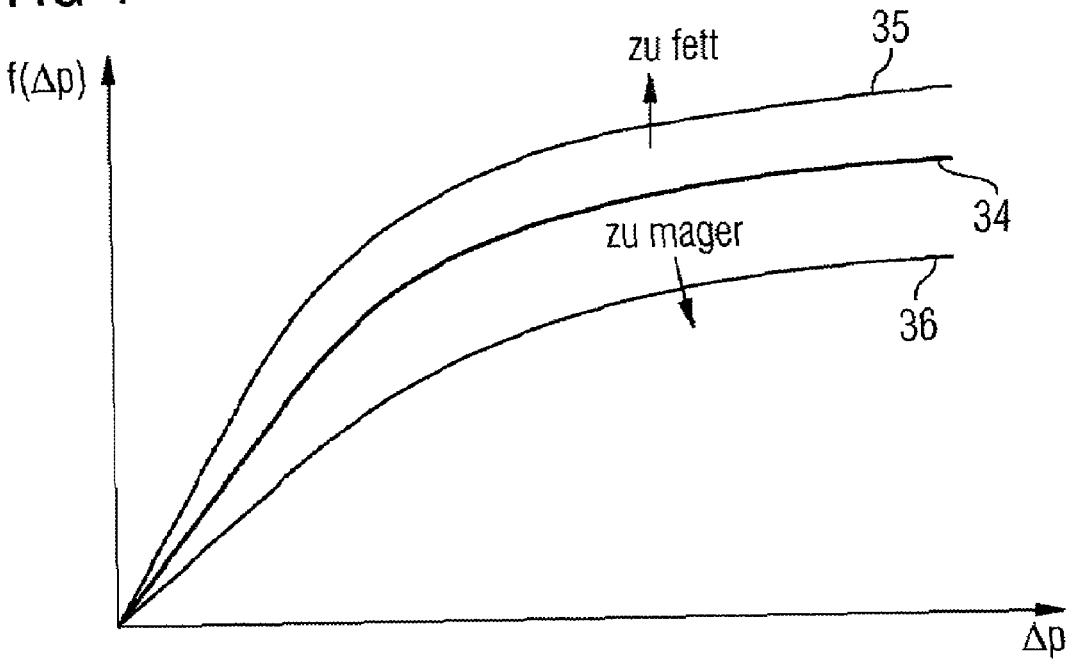
FIG. 4 shows a characteristic curve for changing the intermediate value as a function of the tank pressure difference.

The possible appearance of a function $f(\Delta p)$ is shown by way of example in FIG. 4 in the form of a characteristic curve 34. The raising of $f(\Delta p)$ when operation is too rich and the lowering when operation is too lean are clarified by way of the resulting characteristic curves 35 and 36.

Figure 5:
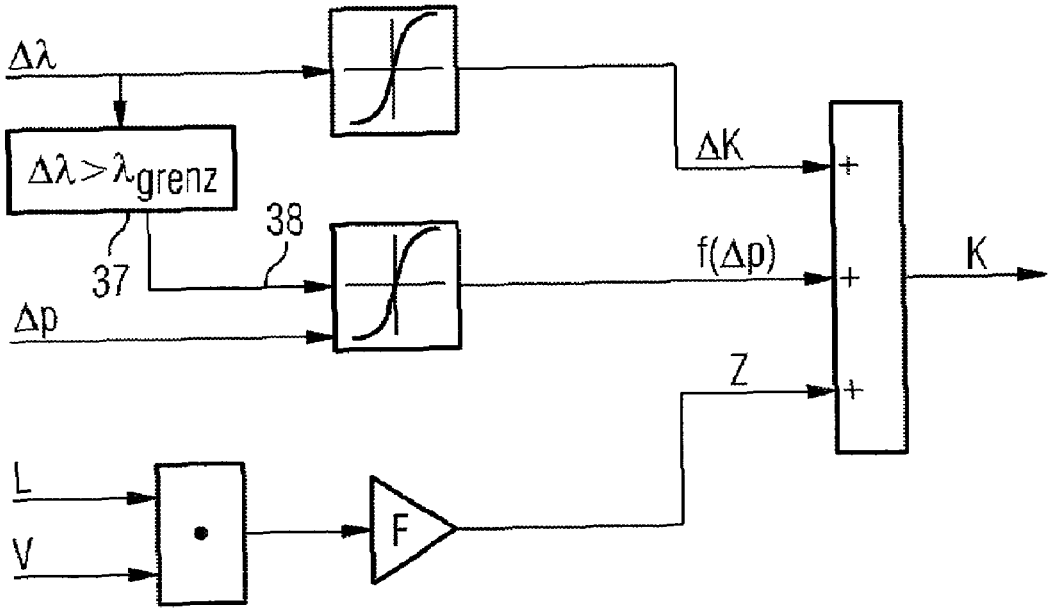
FIG. 5 shows a block circuit diagram for determining the additive correction value.

FIG. 5 shows another type of representation of the method described with reference to FIG. 3. The block circuit diagram shows clearly how the correction value K is ultimately made up of three individual elements, the intermediate value Z calculated from the loading L and the volume flow V, the element $f(\Delta p)$, which is a function of the tank pressure difference, and the element $\Delta K$, which is a function of the air ratio difference $\Delta\lambda$. The adjustment of the characteristic curve pattern of $f(\Delta p)$ when the limit value $\lambda_{limit}$ is exceeded, is shown by way of the function block 37 and the additional input variable 38.

What is claimed is:

1. A method for determining an additive correction value for correcting the quantity of fuel injected in an internal combustion engine, wherein in the tank ventilation system a tank ventilation valve is disposed in a regeneration line, which connects a retention vessel collecting fuel gas from a fuel tank to an intake pipe of the internal combustion engine, the method comprising the steps of:

sealing off the tank ventilation system in an airtight manner from the atmosphere prevailing outside the motor vehicle, opening the tank ventilation valve to build up a negative pressure in the tank ventilation system, determining the loading of the retention vessel with fuel gas, determining the volume flow through the tank ventilation valve, calculating an intermediate value from the product of loading and volume flow, determining a tank pressure difference between the pressure in the fuel tank and the atmospheric pressure, and determining the additive correction value by adjusting the intermediate value to the size of the tank pressure difference.

2. The method according to claim 1, wherein the intermediate value is enlarged as the tank pressure difference increases.

3. The method according to claim 1, wherein the product of loading and volume flow is scaled with a freely calibratable factor.

4. The method according to claim 1, wherein the difference between the air ratio of the exhaust gas of the internal combustion engine measured by a lambda probe and the air ratio to be set by a lambda regulator is determined and the additive correction value is changed as a function of the difference.

5. The method according to claim 4, wherein the additive correction value is reduced, if the difference between the air ratio to be set and the air ratio measured indicates an operation of the internal combustion engine that is too lean.

6. The method according to claim 4, wherein the additive correction value is enlarged, if the difference between the air ratio to be set and the air ratio measured indicates an operation of the internal combustion engine that is too rich.

7. The method according to claim 4, wherein the difference is compared with a predetermined limit value and if it exceeds the limit value, the degree of adjustment of the intermediate value to the tank pressure difference is changed.

8. The method according to claim 2, wherein the adjustment of the intermediate value to the tank pressure difference is effected by way of a characteristic curve, the rise of which is constantly positive above the tank pressure difference and that the characteristic curve is lowered during operation that is too lean and raised during operation that is too rich.

9. The method according to claim 1, wherein the loading of the retention vessel is determined from the difference between the air ratio of the exhaust gas of the internal combustion engine measured by a lambda probe and the air ratio to be set by a lambda regulator, with the difference being determined during an opening phase of the tank ventilation valve.

10. A system for determining an additive correction value for correcting the quantity of fuel injected in an internal combustion engine, comprising a tank ventilation system in which a tank ventilation valve is disposed in a regeneration line, which connects a retention vessel collecting fuel gas from a fuel tank to an intake pipe of the internal combustion engine, the system including:

a sealing valve to seal off the tank ventilation system in an airtight manner from the atmosphere prevailing outside the motor vehicle, a tank ventilation valve being opened to build up a negative pressure in the tank ventilation system, and an engine controller configured:

to receive a value of the loading of the retention vessel with fuel gas, to receive a value of the volume flow through the tank ventilation valve, to calculate an intermediate value from the product of loading and volume flow, to determine a tank pressure difference between the pressure in the fuel tank and the atmospheric pressure, and to determine the additive correction value by adjusting the intermediate value to the size of the tank pressure difference.

11. The system according to claim 10, wherein the intermediate value is enlarged as the tank pressure difference increases.

12. The system according to claim 10, wherein the product of loading and volume flow is scaled with a freely calibratable factor.

13. The system according to claim 10, wherein the difference between the air ratio of the exhaust gas of the internal combustion engine measured by a lambda probe and the air ratio to be set by a lambda regulator is determined and the additive correction value is changed as a function of the difference.

14. The system according to claim 13, wherein the additive correction value is reduced, if the difference between the air ratio to be set and the air ratio measured indicates an operation of the internal combustion engine that is too lean.

15. The system according to claim 13, wherein the additive correction value is enlarged, if the difference between the air ratio to be set and the air ratio measured indicates an operation of the internal combustion engine that is too rich.

16. The system according to claim 13, wherein the difference is compared with a predetermined limit value and if it exceeds the limit value, the degree of adjustment of the intermediate value to the tank pressure difference is changed.

17. The system according to claim 11, wherein the adjustment of the intermediate value to the tank pressure difference is effected by way of a characteristic curve, the rise of which is constantly positive above the tank pressure difference and that the characteristic curve is lowered during operation that is too lean and raised during operation that is too rich.

18. The system according to claim 10, wherein the loading of the retention vessel is determined from the difference between the air ratio of the exhaust gas of the internal combustion engine measured by a lambda probe and the air ratio to be set by a lambda regulator, with the difference being determined during an opening phase of the tank ventilation valve.

* * * * *